US010894999B2

(12) United States Patent
Wrobel et al.

(10) Patent No.: US 10,894,999 B2
(45) Date of Patent: Jan. 19, 2021

(54) PROCESS AND APPARATUS FOR PRODUCING URANIUM OR A RARE EARTH ELEMENT

(71) Applicant: OUTOTEC (FINLAND) OY, Espoo (FI)

(72) Inventors: Maciej Wrobel, Karben (DE); Jochen Güntner, Kahl (DE); Alexandros Charitos, Frankfurt am Main (DE); Jörg Hammerschmidt, Erlensee (DE)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/762,743

(22) PCT Filed: Jun. 30, 2016

(86) PCT No.: PCT/EP2016/065288
§ 371 (c)(1),
(2) Date: Mar. 23, 2018

(87) PCT Pub. No.: WO2017/054944
PCT Pub. Date: Apr. 6, 2017

(65) Prior Publication Data

US 2018/0216209 A1 Aug. 2, 2018

(30) Foreign Application Priority Data

Sep. 29, 2015 (DE) ..... 10 2015 116 476

(51) Int. Cl.
*C22B 60/02* (2006.01)
*C22B 1/06* (2006.01)
(Continued)

(52) U.S. Cl.
CPC ..... *C22B 60/0208* (2013.01); *C22B 1/06* (2013.01); *C22B 1/2406* (2013.01); *C22B 5/14* (2013.01); *C22B 59/00* (2013.01); *C22B 60/0213* (2013.01)

(58) Field of Classification Search
None
See application file for complete search history.

(56) References Cited

U.S. PATENT DOCUMENTS 2,607,666 A 8/1952 Martin
3,250,589 A * 5/1966 Meyer ..... C22B 60/0208 423/20

(Continued)

FOREIGN PATENT DOCUMENTS

CN 1847419 A * 10/2006
DE 262845 A1 * 12/1988

(Continued)

OTHER PUBLICATIONS

DD 262845 English abstract (Year: 1988).*

(Continued)

*Primary Examiner* — Paul A Wartalowicz
*Assistant Examiner* — Stephani Hill
(74) *Attorney, Agent, or Firm* — Buchanan Ingersoll & Rooney PC

(57) ABSTRACT

In a process for producing uranium and/or at least one rare earth element selected from the group consisting of cerium, dysprosium, erbium, europium, gadolinium, holmium, lanthanum, lutetium, neodymium, praseodymium, promethium, samarium, scandium, terbium, thulium, ytterbium and yttrium out of an ore, the ore is mixed with sulphuric acid with a concentration of at least 95 wt.-% to a mixture, wherein the mixture is granulated to pellets. The pellets are fed into at least one fluidized bed fluidized by a fluidizing (Continued)

gas for a thermal treatment at temperatures between 200 and 1000° C. The at least one fluidized bed is developed such that it at least partly surrounds a gas supply tube for a gas or a gas mixture fed into the reactor and the gas or gas mixture is used as a heat transfer medium.

2 Claims, 1 Drawing Sheet

(51) Int. Cl.

| | |
|---|---|
| ***C22B 59/00*** | (2006.01) |
| ***C22B 5/14*** | (2006.01) |
| ***C22B 1/24*** | (2006.01) |

(56) References Cited

U.S. PATENT DOCUMENTS

| | | | | |
|---|---|---|---|---|
| 3,578,798 | A | 5/1971 | Lapple et al. | |
| 5,480,470 | A * | 1/1996 | Miller | B22F 9/082 264/12 |
| 5,787,332 | A | 7/1998 | Black et al. | |
| 6,312,500 | B1 * | 11/2001 | Duyvesteyn | C22B 1/243 75/712 |
| 2006/0228281 | A1 * | 10/2006 | Stroder et al. | B01D 53/12 423/212 |
| 2006/0249100 | A1 * | 11/2006 | Freytag | B01J 8/0025 122/400 |
| 2007/0137435 | A1 | 6/2007 | Orth et al. | |
| 2008/0016986 | A1 * | 1/2008 | Liu | C22B 3/42 75/407 |
| 2010/0040512 | A1 * | 2/2010 | Orth | B01J 8/18 422/147 |
| 2010/0154593 | A1 * | 6/2010 | Ratchev | C22B 3/42 75/425 |
| 2013/0340571 | A1 | 12/2013 | Agin et al. | |
| 2014/0322106 | A1 * | 10/2014 | Dimitrakis | C22B 1/00 423/1 |
| 2015/0082943 | A1 * | 3/2015 | Cartagena Fagerstrom | C22B 15/0073 75/300 |
| 2016/0153070 | A1 * | 6/2016 | Duyvesteyn | C22B 3/0005 75/743 |

FOREIGN PATENT DOCUMENTS

| | | | | |
|---|---|---|---|---|
| EP | 2 859 128 | B1 | 4/2016 | |
| GB | 2028159 | A * | 3/1980 | B01J 8/20 |
| WO | WO 2004/057039 | A1 | 7/2004 | |
| WO | WO 2012/093170 | A1 | 7/2012 | |
| WO | WO-2017054944 | A1 * | 4/2017 | C22B 1/2406 |

OTHER PUBLICATIONS

CN 1847419 machine translation (Year: 2006).*

International Search Report (PCT/ISA/210) dated Sep. 7, 2016, by the European Patent Office as the International Searching Authority for International Application No. PCT/EP2016/065288.

Written Opinion (PCT/ISA/237) dated Sep. 7, 2016, by the European Patent Office as the International Searching Authority for International Application No. PCT/EP2016/065288.

German Search Report dated Jun. 28, 2016, issued by the German Patent Office in the corresponding German Patent Application No. O1P268. (9 pages).

Kul, M. et al, "Rare Earth Double Sulfates From Pre-Concentrated Bastnasite", Hydrometallurgy, vol. 93, No. 3-4, pp. 129-135, Aug. 1, 2008, XP0022757951.

Munkhtsetseg, B. et al., "Technological Pretreatment of the Synchysite Non-Oxidized Ore", AIP Conference Proceedings, 1542, Jan. 1, 2013, XP055298427.

PCT International Preliminary Report on Patentability (IPRP) and Written Opinion dated Apr. 12, 2018, in corresponding International Application No. PCT/EP2016/065288 (7 pages).

* cited by examiner

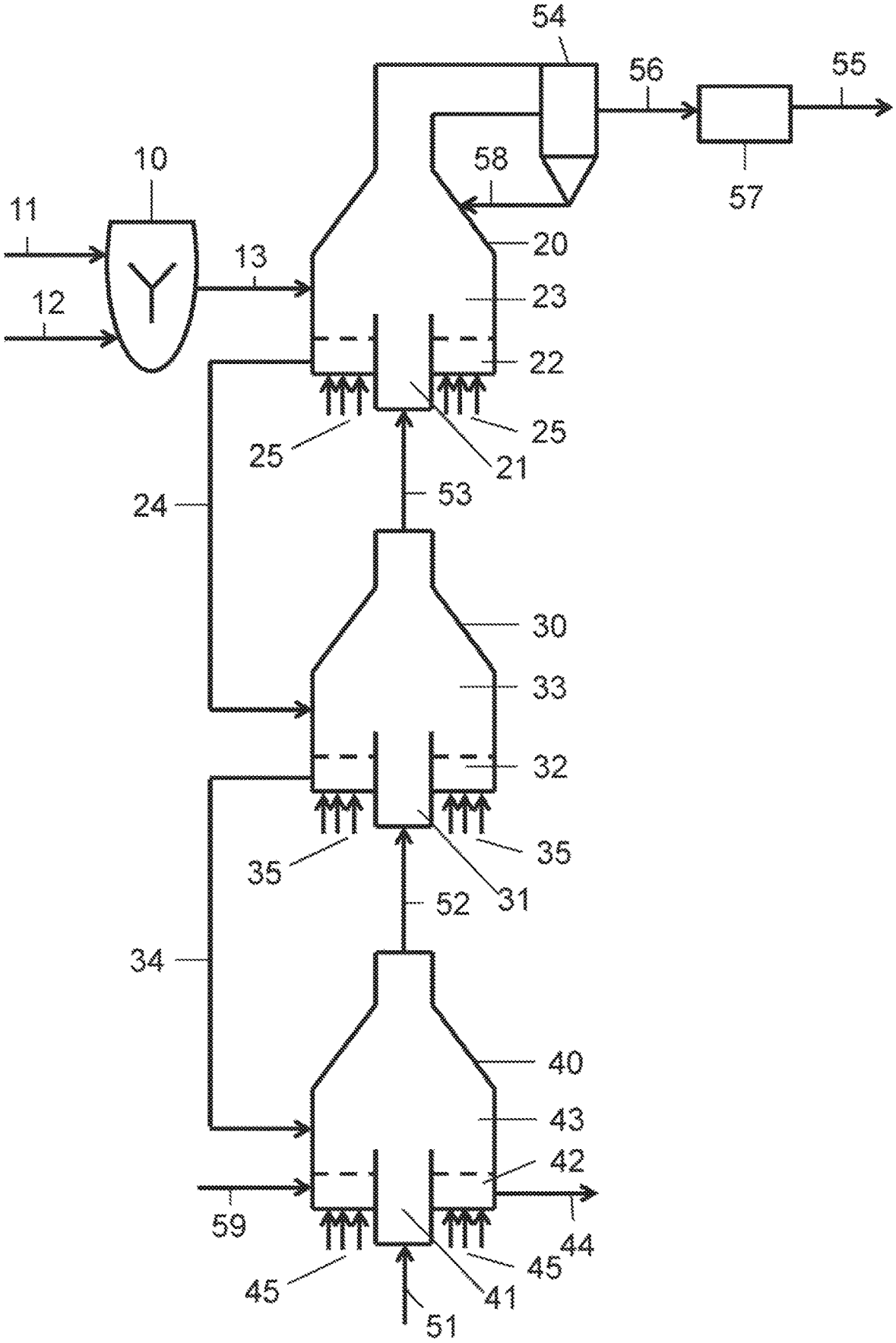
54
56
55
10
58
57
11
20
13
23
12
22
25
25
21
24
53
30
33
32
35
35
31
52
34
40
43
42
59
44
45
45
41
51

PROCESS AND APPARATUS FOR PRODUCING URANIUM OR A RARE EARTH ELEMENT

The invention relates to a process and its corresponding plant for producing uranium and/or at least one rare earth element selected from the group consisting of cerium, dysprosium, erbium, europium, gadolinium, holmium, lanthanum, lutetium, neodymium, praseodymium, promethium, samarium, scandium, terbium, thulium, ytterbium and yttrium out of an ore, wherein the ore is mixed with sulphuric acid with a concentration of at least 95 wt.-% to a mixture, wherein the mixture is granulated to pellets and wherein the pellets are fed into at least one fluidized bed fluidized by a fluidizing gas for a thermal treatment at temperatures between 200 and 1000° C.

Uranium is weakly radioactive because all its isotopes are unstable. Concluding, most of the contemporary uses of uranium exploit its unique nuclear properties.

Another possible product of the inventive process is one or more rare earth element. This group of elements is defined by IUPAC and listed 15 lanthanides cerium, dysprosium, erbium, europium, gadolinium, holmium, lanthanum, lutetium, neodymium, praseodymium, promethium, samarium, terbium, thulium, ytterbium as well as scandium and yttrium. Despite their name, rare earth elements are—with exception of the radioactive promethium—relatively plentiful in Earth's crust.

However, because of their geochemical properties, rare earth elements are typically dispersed and not often found concentrated. Typical impurities are uranium, thulium, manganese, magnesium, phosphates, carbonates and aluminum. Often iron is contained in the respective ores as well. These impurities have to be removed from the ore, which is often done by a so called acid cracking. Thereby, the ore is mixed together with an acid, preferably with sulphuric acid. The process is also known as acid baking. The powdered ore is mixed with concentrated sulphuric acid and baked at temperatures between 200 and 400° C. for several hours in a rotary kiln as it is e.g. proposed by Alkane Resources LTD.

Afterwards, the resulting cake is leached with water to dissolve the rare earth elements as sulfates. A number of sulphates forming impurities (as Fe, Al) are dissolved as well in this stage and have to be separated from the rare earths in subsequent cleaning stages. Decomposition in HCl is commonly applied for carbonate minerals.

The problem of this well-known process is a relatively low turnover in a rotary kiln. To avoid acid losses through evaporation the rotary kiln should be heated indirectly whereby this process cannot be upscaled unlimited. Furthermore, the temperature profile in a rotary kiln is such that the temperature falls easily below the due point of sulphuric acid in certain furnace areas, which makes the use of expensive steel materials necessary. Concluding, $SO_3$ condenses out in the kiln which leads to a high corrosion.

It is, therefore, object of the present invention to provide a method for the production of rare earth elements and/or uranium from an ore with higher space-time-yield. Further, the used reactor should not be prone to corrosion.

An ore, containing uranium and/or cerium, dysprosium, erbium, europium, gadolinium, holmium, lanthanum, lutetium, neodymium, pra-seodymium, promethium, samarium, scandium, terbium, thulium, ytterbium and yttrium is mixed with sulphuric acid in concentration of at least 95 wt.-%. The ratio between ore and sulphuric acid should be between 0.5:1 to 1.5:1, preferably 0.8:1 to 1.2:1.

The resulting mixture is granulated into pellets. The mixing time should be at least 1 minute, preferably 5 minutes. Thereby, stable granulation is achieved.

In general, sulphation with sulfuric acid requires temperature above dew point of generated $SO_3$-containing offgas (160-220° C.) and below boiling temperature of the acid (which is around 330° C.), Some of the impurities, mainly iron, aluminum and manganese, are also converted to sulfates with loss of free water. All the conventional reactions are exothermic. The increase of the temperature should be limited to a mixture temperature of no more than 150° C., preferably 120° C. out of safety reasons. Further, corrosion in this process step can be avoided by controlling the temperature.

The resulting pellets are fed into at least one fluidized bed, which is fluidized by a fluidizing gas. In this fluidized bed, the thermal treatment takes place at temperatures between 150 and 250° C. The at least one fluidized bed is developed such that it at least partly surrounds the gas supply tube for gas or gas mixture. Thereby, an annular fluidized bed is adjusted around the gas supply tube. Preferably, the gas supply tube itself is arranged such that it introduces the gas or gas mixture into a mixing chamber, which is located above the resulting fluidized bed inside of the reactor.

The preferably resulting circulating annular fluidized bed has the advantages of a stationary fluidized bed, such as sufficiently long solid retention time and the advantages of a circular fluidized bed, such as very good mass and heat transfer. Surprisingly, the disadvantages of both systems are not found.

In the upper region of the central gas supply tube, the first gas or gas mixture entrains solids from the annular stationary fluidized bed into the mixing chamber so that due to the high velocities between the solids and the first gas, an intensively mixed suspension is formed at an optimum heat and mass transfer.

By correspondingly adjusting the bed in the annular fluidized bed as well as the gas velocities of the first gas or gas mixture and of the fluidizing gas, the solid density of the suspension above the orifice region of the gas supply tube can be varied within wide ranges. In the case of high solids loading of the suspension in the mixing chamber, a large part of the solids will separate out of the suspension and fall back into the annular fluidized bed. The solid circulation is called internal solids recirculation, the stream of solids circulating in this internal circulation normally being significantly larger than the amount of solids supplied to the reactor from outside. The retention time of the solids in the reactor can be varied within a wide range. Due to the high solids loading on the one hand and the good suspension of the solids in the gas chamber on the other hand, excellent conditions for good mass and heat transfer are obtained above the orifice region of the gas supply system.

Further it is one important point, that the gas or gas mixture is used as a heat transfer medium. This means, the gas or gas mixture introduced via the gas supply tube is already heated. Thereby, the hot gas introduced in the reactor in the so called mixing chamber transfers the required energy into the reactor. Thereby, no hot spots occur into the fluidized bed, since the heating of the particle mainly takes place in the region above the annular fluidized bed, namely in the so called mixing chamber.

The acid containing material enters the rotary kiln at a temperature around 100° C. (discharge temperature of mixer or slightly less). Heat transfer to the material is mostly achieved by externally burners through the kiln wall. The material heats up and sulfation increases. During sulfation gaseous $SO_3$ is formed. In the temperature zone where the material temperature has not yet reached the due point temperature corrosion occurs. Same happens if a direct burner is installed. The difference to the fluid bed furnace is that a rotary kiln has a temperature gradient along its length while the fluid bed furnace has a constant temperature (above due point) and fresh material is absorbed in a bed of already hot sulfated material.

Further, it is preferred that the gas or gas mixture is an off-gas of a downstream process stage. Thereby, the energy balance of the whole process can be optimized. Further, since the gas or gas mixture is introduced via the gas supply system into the reactor, it is not necessary to clean this off-gas, but contained particle will be fed back into the process.

Further, it is preferred that the pellets feature in average diameter between 100 and 500 μm, preferably 100 to 250 μm. Also, not more than 10 wt-%, preferred 3 wt.-% of the pellets have a size above 1 mm. The particle size range of the pellets is essential for creating a fluidized bed wherein all particles have the same residence time.

It is another aspect of the invention that the off-gas of a downstream process stage is used as the gas or gas mixture for a process stage with a so called low temperature heating, wherein the heating is performed at temperatures between 200 and 350° C. and the off-gas of the low temperature heating is used as the gas mixture for the above described preheating stage at a temperature between 150 and 250° C. in an annular circulating fluidized bed. These are temperatures wherein such kind of heat transfer is most efficient.

However, it is more preferred that even the low temperature heating is performed in a fluidized bed system. Thereby, a further high temperature heating at temperatures between 500 and 800° C. performed in the fluidized bed according to the invention should be performed. Thereby off-gases of the high temperature heating can be used as the gas mixture for low temperature heating while the low temperature heating off-gases are used as a heat transfer medium for preheating. So, only the high temperature heating stage has to be heated by an external heat source, which will optimize the energy balance of the whole system and also simplify the process design.

In a further embodiment of the invention, the off-gas of the fluidized bed, most preferred the off-gas of the preheating stage, is supplied into a gas cleaning to remove $SO_2$ and $SO_3$ gases. Preferably, these gases are led to a post combustion stage in order to decompose $SO_3$ to $SO_2$ and further to an absorption into the fluid acid to produce $H_2SO_4$.

It is also preferred that the residence time in the preheating stage is between several seconds and 5 minutes, preferably between 1 and 3 minutes, and/or the residence time in the low temperature heating is between 5 and 20 minutes, preferably 5 and 10 minutes and also the residence time in the high temperature heating is between 5 and 20 minutes, preferably 8 to 15 minutes. Thereby, a homogenous heating of ore particles is ensured at a high time-space-yield.

Another aspect of the current invention is a plant for producing uranium and/or at least one rare earth element selected from the group consisting of cerium, dysprosium, erbium, europium, gadolinium, holmium, lanthanum, lutetium, neo-dymium, praseodymium, promethium, samarium, scandium, terbium, thulium, ytterbium and yttrium out of an ore. Such a plant comprises at least one granulation to mix the ore with sulphuric acid with a concentration of at least 95 wt.-%, preferably 98 wt.-%. In this granulation, the mixture is also granulated to pellets.

Further, this plant comprises a venturi or fluidized bed reactor for a heat treatment at temperatures between 150 and 250° C. featuring a feeding line to feed the pellets into the fluidized bed. Further, the fluidized bed reactor has a gas supply system, which is surrounded by a chamber which extends at least partly around the gas supply tube and in which a stationary annular fluidized bed is formed during operation. Further, the plant comprises a downstream process stage and an off-gas line, connecting the downstream process stage to the gas supply system of the fluidized bed reactor such that the off-gas of the downstream process stage is used as gas mixture introduced via the gas supply system into the fluidized bed reactor as a heat transfer medium. Thereby, the energy efficiency of the process is increased.

Further, in a preferred embodiment the gas supply system has a gas supply tube extending upwards substantially vertically from the lower region of the fluidized bed reactor into a so called mixing chamber of the fluidized bed reactor. Thereby, the gases introduced in the reactor are such, that the gas flowing from the gas supply system entrance solids from the stationary annular fluidized bed into the mixing chamber.

However, it is also possible that the gas supply system ends below the surface of the annular fluidized bed. Then, the gas is introduced into the annular fluidized bed for example via lateral patches, entering solids from the annular fluidized bed into the mixing chamber due to its flow velocity.

Preferred is a central tube as a gas supply system. The central tube may be formed at its outlet opening as a nozzle and/or have one or more distributed patches in its shared surface led during the operation of the reactor solids constantly get into the central tube so the patches are entered by the first gas or gas mixture to the central tube into the mixing chamber. Of course, two or more central tubes with different or identical dimension and shape may also be provided in the reactor. Preferably, however, at least one of the central tubes is arranged approximately centrally with reference to the cross-sectional area of the reactor.

In accordance with a preferred embodiment, a separator, in particular a cyclone is provided downstream of each fluidized bed according to the invention, for the separation of solids.

Developments, advantages and application possibilities of the invention also emerge from the following description of the process. All features described and/or illustrated in the drawing form the subject matter of the invention per se or in any combination independently of their inclusion in the claims or their back references.

BRIEF DESCRIPTION OF THE DRAWINGS

FIG. 1 shows a schematically process in accordance with the present invention.

Ore containing uranium and/or at least one element of the group cerium, dysprosium, erbium, europium, gadolinium, holmium, lanthanum, lutetium, neodymium, praseodymium, promethium, samarium, scandium, terbium, thulium, ytterbium and yttrium is pulverized and fed into the granulation 11. Therein, it is mixed with sulphuric acid from acid line 12. The resulting mixture is pelletized to pellets, wherein at least 90% of the pellets have a diameter between 150 and 300 μm. The temperature in the granulation is between 80 and 120° C.

Resulting pellets are fed via line 13 into a fluidized bed reactor 20. The fluidized bed reactor for preheating 20 is designed such that during operating it features a circulating annular fluidized bed for preheating 22. The fluidized bed for preheating 22 is fluidized via lines 25. A gas mixture system for preheating 21 is positioned such that an annular fluidized bed for preheating 22 surrounds the gas supply system for preheating 21. The end of the gas supply system for preheating 21 is above the annular fluidized bed for preheating 22 in a mixing chamber for preheating 23, Instead of a fluidized bed reactor the preheating equipment can be a venturi.

The gas mixture in the gas supply system 21 fed via line 53 is the off-gas of a second heating stage, the so called lower heating stage which is performed in the fluidized bed reactor for low temperature heating 30. The design of the fluidized bed reactor for low temperature heating 30 corresponds to the design of fluidized bed reactor for preheating 20. The annular fluidized bed for low temperature heating 32 is fluidized via lines 35. It includes also a gas supply system for low temperature heating 31, surrounded by an annular fluidized bed for low temperature heating 32 during operation. The gas supply system for low temperature heating 31 ends above the annular fluidized bed for low temperature heating 32 into the so called mixing chamber for low temperature heating 33. The gas fed to the gas supply system for low temperature heating 31 fed via line 52 is the off-gas of the fluidized bed reactor for high temperature heating 40.

Also fluidized bed reactor for high temperature heating 40 is designed with a circulating annular fluidized bed for high temperature heating 42 and with a gas supply system for high temperature heating 41 surrounded by a circulating annular fluidized bed for high temperature heating 42 being fluidized via lines 45. During operation, the gas supply system ends upon the annular fluidized bed for high temperature heating 42 in the mixing chamber for high temperature heating 43.

The gas mixture for fluidized bed for high temperature heating 40 is supplied via line 51. The gas mixture of line 51 can be air, which is used as combustion air for combustion of fuel introduced into fluidized bed reactor 40. Fuel can be coal, natural gas, diesel oil, heavy fuel oil, etc. and is introduced via line 59.

The resulting sulfates from this process are withdrawn from the annular fluidized bed 42 via line 44 and led to further process stages like leaching. Also, remaining solids are filtered. In the not shown leaching, the uranium and/or at least one rare earth element is a soluble sulfate form that dissolves in water at elevated temperature while the bulk of impurities like iron are insoluble oxides. After leaching these impurities are removed via a solid/liquid separation step. The remaining filtrate contains dissolved uranium and/or at least one rare earth element. Possibly contained dissolved impurities are removed in further purification stages. The final solution contains only the valuable elements (uranium and/or at least one rare earth element). This solution passes through further treatment stages for recovery of the valuable elements in the desired compound.

To optimize the energy balance of the shown process, off-gas of the high temperature reactor 40 is used as a heat transfer medium supplied via the gas supply system in low temperature fluidized bed reactor 30, while the off-gas of the fluidized bed reactor for low temperature heating 30 is transported via line 53 into the fluidized bed reactor for preheating 20 as a heat transfer medium.

The resulting off-gas is passed to a separator 54, wherein the solids are separated from the gas. The solids are passed back into the preheating fluidized bed reactor 20 via line 52, while the gas is passed through a gas cleaning stage 57 via line 56. In the gas cleaning stage 57, $SO_3$ is decomposed to $SO_2$. Those gases are passed via line 58 into a not shown sulphuric acid plant.

REFERENCE LIST

10 acid mixing and granulation
11-13 line
20 fluidized bed reactor or venturi for preheating
21 gas supply system for preheating
22 annular fluidized bed for preheating
23 mixing chamber for preheating
24 line
25 fluidizing gas system for preheating
30 fluidized bed reactor for low temperature heating
31 gas supply system for low temperature heating
32 annular fluidized bed for low temperature heating
33 mixing chamber for low temperature heating
34 line
35 fluidizing gas system for low temperature heating
40 fluidized bed reactor for high temperature heating
41 gas supply system for high temperature heating
42 annular fluidized bed for high temperature heating
43 mixing chamber for high temperature heating
44 line
45 fluidized gas system
51-53 line
54 separator
55, 56 line
57 gas cleaning
58, 59 line

The invention claimed is:

1. Process for producing uranium (U) and/or at least one rare earth element selected from the group consisting of cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb) and yttrium (Y) out of an ore, the process comprising:

mixing the ore with sulphuric acid having a concentration of at least 95 wt.-% to form a mixture, granulating the mixture into pellets, and feeding the pellets sequentially into a first fluidized bed, a second fluidized bed, and a third fluidized bed, in the stated order, wherein the first, second, and third fluidized beds are connected in series and each is fluidized by a separate fluidizing gas, wherein each of the first, second and third fluidized beds at least partly surrounds a gas supply tube for feeding a gas or a gas mixture, wherein the gas or gas mixture is used as a heat transfer medium in the first, second and third fluidized bed, wherein off-gas of a low temperature heating in the second fluidized bed performed at temperatures between 200 and 350° C. is used as the gas or the gas mixture in the first fluidized bed for a preheating performed at temperatures between 150 and 250° C., and off-gas of a high temperature heating in the third fluidized bed performed at temperatures between 500 and 800° C. is used as the gas or the gas mixture in the second fluidized bed for the low temperature heating, wherein the pellets have an average diameter between 100 and 500 μm and/or 10 wt.-% of the pellets have a diameter of more than 1 mm, and wherein the residence time in the preheating is between 1 s and 5 minutes, the residence time in the low temperature heating is between 5 and 20 minutes, and the residence time in the high temperature heating is between 5 and 20 minutes.

2. Process according to claim 1, wherein an off-gas of the preheating is fed into a gas cleaning stage.

* * * * *